US007891518B2

(12) United States Patent
Snyder et al.

(10) Patent No.: US 7,891,518 B2
(45) Date of Patent: Feb. 22, 2011

(54) WIDE-DISPERSAL PACKAGE AND CAP ASSEMBLY

(75) Inventors: David A. Snyder, West Chicago, IL (US); Scott Seanor Wolff, Windermere, FL (US)

(73) Assignee: Tricorbraun Inc., St. Louis, MO (US)

( * ) Notice: Subject to any disclaimer, the term of this patent is extended or adjusted under 35 U.S.C. 154(b) by 1188 days.

(21) Appl. No.: 11/418,784

(22) Filed: May 5, 2006

(65) Prior Publication Data

US 2006/0273096 A1 Dec. 7, 2006

Related U.S. Application Data

(60) Provisional application No. 60/678,868, filed on May 7, 2005.

(51) Int. Cl.

| | |
|---|---|
| ***B65D 51/18*** | (2006.01) |
| ***B65D 51/16*** | (2006.01) |
| ***B65D 43/08*** | (2006.01) |
| ***B65D 43/14*** | (2006.01) |
| ***B65D 47/00*** | (2006.01) |
| ***B67D 3/00*** | (2006.01) |

(52) U.S. Cl. ..... 220/254.3; 220/839; 220/367.1; 220/796; 222/480; 222/481; 222/556; 222/565

(58) Field of Classification Search ..... 220/839, 220/796, 367.1, 254.3; 215/235, 309; 222/565, 222/557, 556, 480, 491, 481, 479
See application file for complete search history.

(56) References Cited

U.S. PATENT DOCUMENTS

| | | | | |
|---|---|---|---|---|
| 934,493 | A * | 9/1909 | Wolkenstein | 222/196.2 |
| 3,131,870 | A * | 5/1964 | Henchert | 239/567 |
| 3,782,610 | A * | 1/1974 | Gilbert | 222/484 |
| 4,892,208 | A * | 1/1990 | Sledge | 215/216 |
| 5,230,812 | A * | 7/1993 | Williams | 210/767 |
| 7,134,575 | B2 * | 11/2006 | Vogel et al. | 222/143 |

* cited by examiner

*Primary Examiner*—Robin Hylton
(74) *Attorney, Agent, or Firm*—Husch Blackwell LLP; H. Frederick Rusche

(57) ABSTRACT

A wide-dispersal package cap includes a rim and a domed portion formed within the rim and mounted thereto. The domed portion includes a plurality of orifices each having an internal opening and an external opening relative to a thickness of the domed portion. The orifices are formed spaced apart from one another through the domed portion at an angle, such that the external opening of a particular orifice is off-set from the corresponding internal opening, to thereby enhance wide-dispersal of contents of a package to which the cap is attached.

17 Claims, 4 Drawing Sheets

WIDE-DISPERSAL PACKAGE AND CAP ASSEMBLY

RELATED APPLICATIONS

This application relies upon and claims benefit, under 35 U.S.C. 119(e), of pending U.S. Provisional Patent Application Ser. No. 60/678,868, filed May 7, 2005.

TECHNICAL FIELD OF THE INVENTION

This invention relates generally to the field of molded packaging and, more particularly, to a package cap designed for wide dispersal of liquid, powdered, granulated, or similar products.

DESCRIPTION OF RELATED ART

Previously, packages for dispersal of products such as powders, liquids or granules, such as granules of fertilizer or salt, for example, have included a variety of mechanisms such as spouts, punch-out holes, twist tops with openings, or simply complete removal of the package cap for pour-out of the package contents. These package cap mechanisms permit pouring or sprinkling of contents in a stream or very limited diameter area, i.e. effectively limited to the diameter of the cap opening(s) and offer some amount of control for applications requiring controlled spread. However, there has not been known any satisfactory cap for such a package that permits facile yet wide-spread dispersal of the package contents.

SUMMARY OF THE INVENTION

One aspect of the invention generally pertains to a cap for a package, the cap having a pattern and shape of outlet holes suitable for wide-spread dispersal of the package contents.

Another aspect of the invention pertains to a wide-dispersal cap with a flip top closure.

Yet another aspect of the invention pertains to a one-piece molded cap have an integrated flip top closure and a pattern of bi-level orifices.

Accordingly, in keeping with the above goals and advantages, the invention is, briefly, a wide-dispersal package cap including a rim and a domed portion formed within the rim and mounted thereto. The domed portion includes a plurality of orifices each having an internal opening and an external opening relative to a thickness of the domed portion. The orifices are formed spaced apart from one another through the domed portion at an angle, such that the external opening of a particular orifice is off-set from the corresponding internal opening, to thereby enhance wide-dispersal of contents of a package to which the cap is attached.

The above-mentioned aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1A:
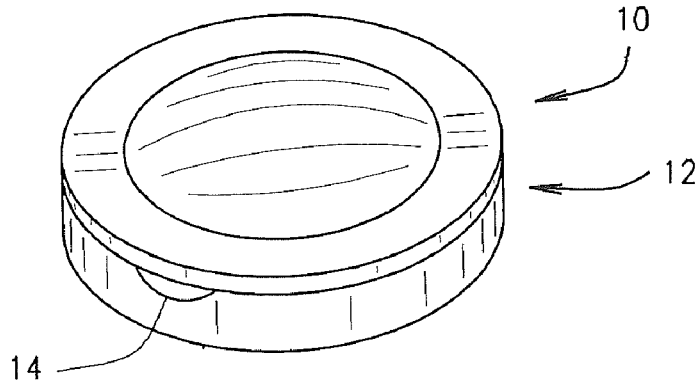
FIG. 1A is a perspective view of the wide-dispersal package cap of the present invention in closed position.
Figure 1B:
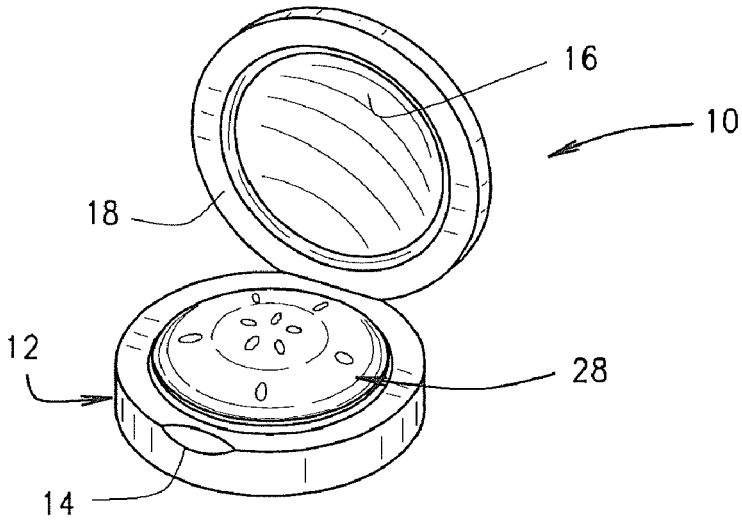
FIG. 1B is a perspective view of the wide-dispersal package cap of FIG. 1A in semi-open position.
Figure 1C:
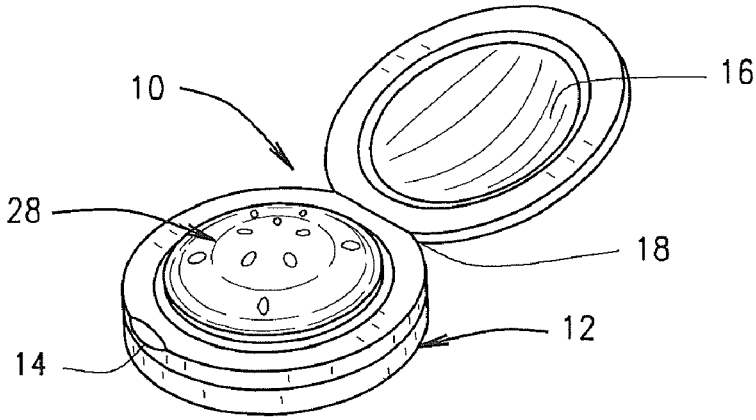
FIG. 1C is a perspective view of the wide-dispersal package cap of FIG. 1A in open position.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 1A-10 illustrate a one-piece wide-dispersal package cap 10 according to one embodiment of the present invention. The cap 10 can be manufactured using any suitable production method and raw materials. However, in the preferred embodiment, the cap is a single molded piece manufactured from a material such as high density polyethylene, polyethylene, or polypropylene. Those of skill in the art will recognize that a number of different materials are suitable for constructing the cap 10.

Cap 10 includes a rim 12 that provides structure, such as a snap-fit, press-fit or threaded engagement for connecting the cap 10 to a package (not shown), such as for example, a bottle, jar or other hand-held container. In alternative embodiments, the cap 10 can be molded with the associated package in a known manner. In the embodiment illustrated in FIGS. 1A-6A the walls of rim 12 are generally vertical, that is, substantially parallel to the longitudinal axis of the cap. Rim 12 is preferably circular in shape, as shown in the disclosed embodiment, and includes a slight recess or depression 14. The recess 14 provides a thumb grip to aid in opening the preferred flip top closure 16. At a point on rim 12, approximately opposite recess 14, a living hinge 18 is provided to integrally connect the rim 12 and the flip top closure 16. While this is the preferred method of connecting a top closure to rim 12, other known structures can be conceived that will suffice and are in keeping with the invention. For example, the closure can be provided as a piece independent from but connectable to the rim.

Figure 6A:
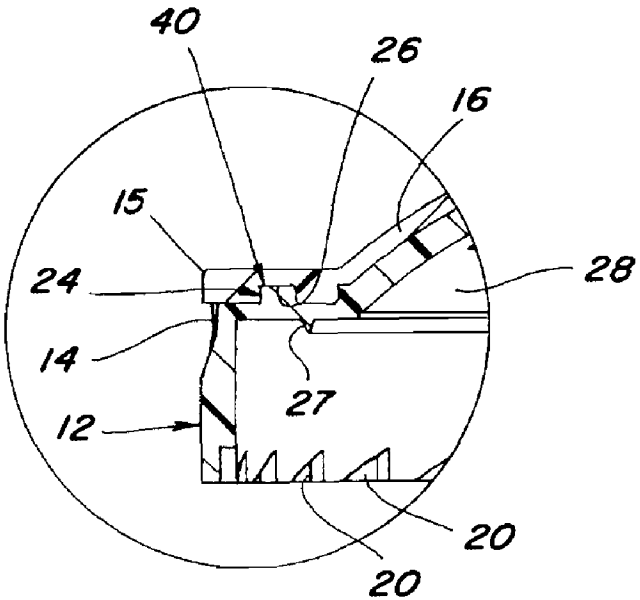
FIG. 6A is an enlarged schematic view of the front portion of the cap of FIG. 6, taken at circle 6A.
Figure 6:
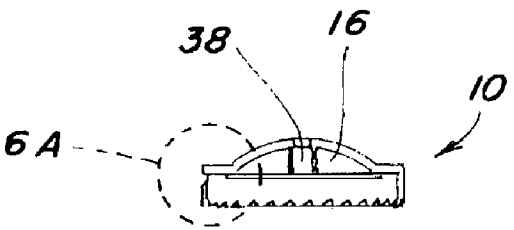
FIG. 6 is a sectional view of a wide-dispersal package cap according to another embodiment.

In the embodiment shown, in FIGS. 6 and 6A, a series of triangular cut-outs or serrations 20 runs along the annular inner side of the wall of the rim 12. These serrations 20 create additional friction and interference at the intersection of the rim 12 and the associated package to inhibit rotation of the cap 10 relative to the package, for child safety purposes.

Figure 5:
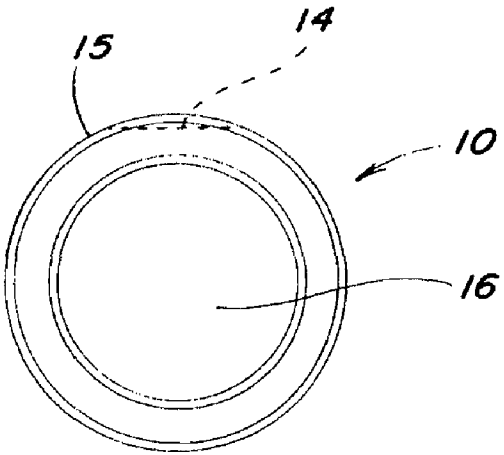
FIG. 5 is a top plan view of the wide-dispersal package cap of FIG. 2 with the flip top closure in the closed position.

As can be seen in FIG. 5 and the enlargement of FIG. 6A, the flip top closure 16 has a diameter roughly equivalent to that of the rim 12. However, the recess 14 in the rim 12 allows the perimeter of flip top closure 16 to slightly overhang the rim 12 at the location of the recess 1.4, thereby providing a small are of the surface upon which to exert an upward force against flip top closure 16 for opening, to expose the domed portion 28 there beneath.

Rim 12 includes an outer annular surface 22. Surface 22 includes a projecting ring 24 having a roughly rectangular cross sectional shape. Other cross-sectional shapes may be used in alternate embodiments. The flip top closure 16 is provided with a correspondingly shaped annular recess 26 that engages the projecting ring 24 of the rim 12 when closure 16 is in the closed position, thereby creating multiple sealing surfaces (FIG. 6A). In the preferred embodiment illustrated, the rim 12 and flip top closure 16 include another projecting ring/recess combination immediately inside of the first ring 24/recess 26 combination to provide additional detenting engagement and sealing surfaces 40.

A valve seal 27 is formed beneath the underside (the container facing side) of the rim's outer surface 22. In a preferred embodiment, valve seal 27 as shown has a triangular cross-sectional shape. However, other cross-sectional shapes may be used. The most beneficial shape for valve seal 27 may be driven by the characteristics of the neck of the package to which the cap 10 is attached. Valve seal 27 captures the neck of the attached package between seal 27 and the interior vertical surface of rim 12 to create a seal between cap 10 and package.

Figure 2:
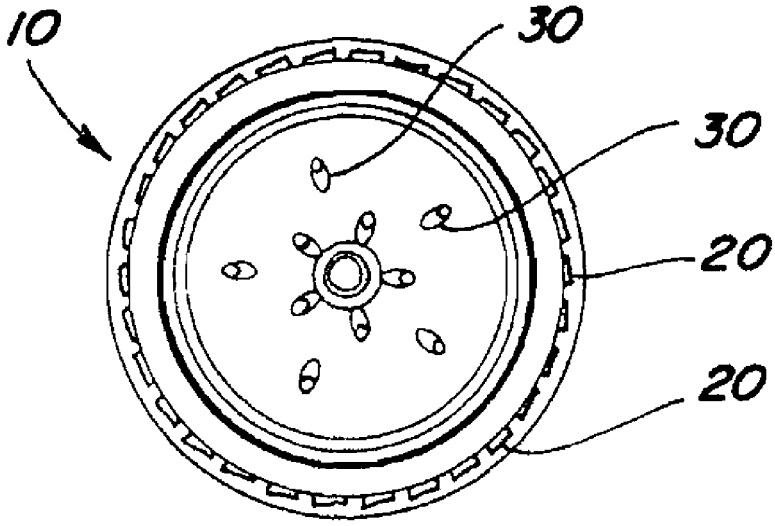
FIG. 2 is a bottom plan view of the wide-dispersal package cap of FIG. 1.
Figure 3:
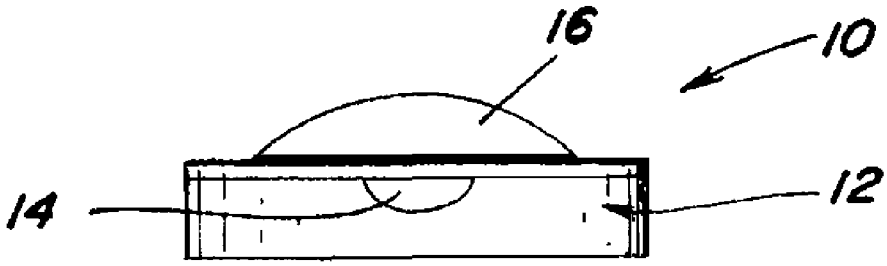
FIG. 3 is a front elevational view of the wide-dispersal package cap of FIG. 2.
Figure 4:
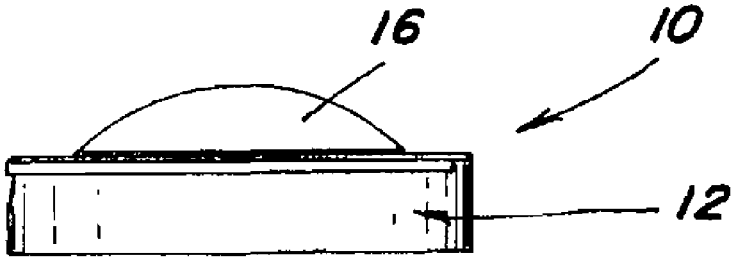
FIG. 4 is a side elevational view of the wide-dispersal package cap of FIG. 2.
Figure 9:
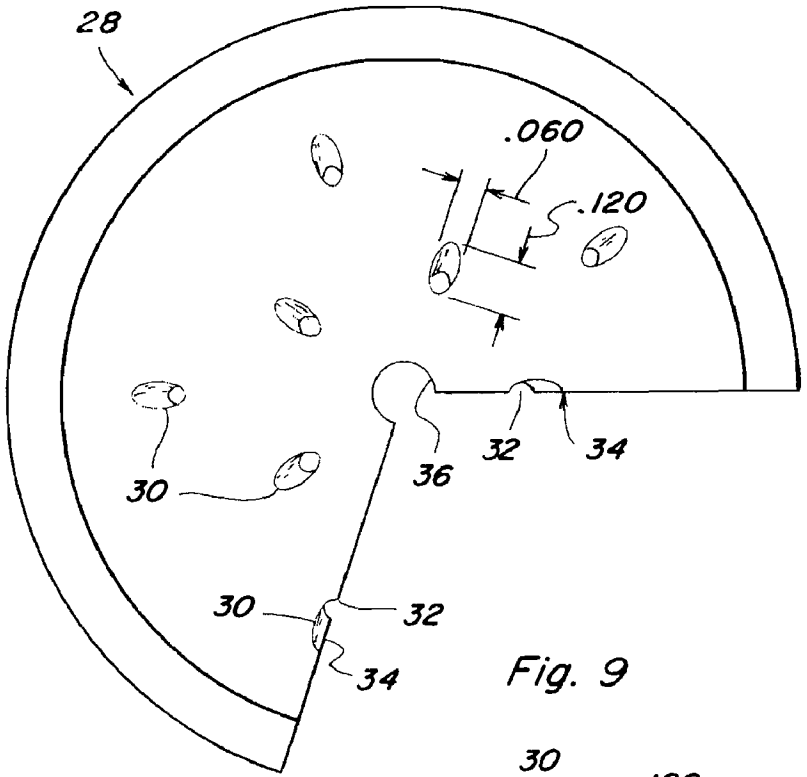
FIG. 9 is an enlarged top plan view of the domed orifice portion of FIG. 7, partially cut away, illustrating the offset hole structure.
Figure 10:
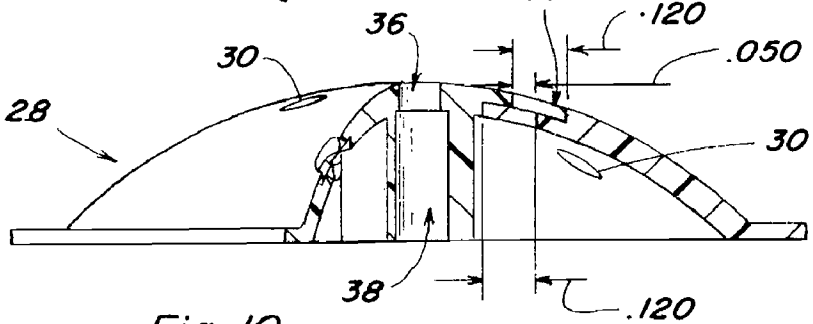
FIG. 10 is an enlarged side elevational view of the domed orifice portion of FIG. 7, partially cut away, illustrating the offset hole structure.
Figure 7:
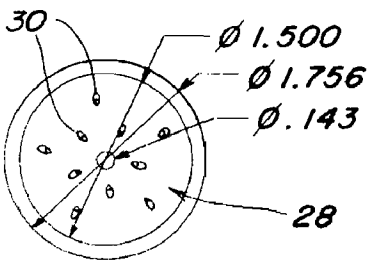
FIG. 7 is a top plan view of the domed orifice portion of another embodiment of the present invention, showing some examples of suitable dimensions.
Figure 8:
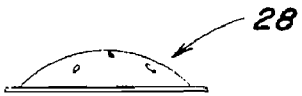
FIG. 8 is a side elevational view of a domed orifice portion of a wide-dispersal package cap of FIG. 7.

Substantially centrally of rim 12, there is a domed portion 28 which curves outwardly toward and into closure 16 when the cap is closed. Dome 28 can be molded to rim 12 as a single piece or conceivably provided as a separate piece from the rim. Domed portion 28 has a plurality of spaced apart through-holes, or orifices 30. Each of the orifices 30 is formed with a bi-level design, as show in FIGS. 9 and 10, with a first (lower) level 32 and a second (upper) level 34. First level 32 and second level 34 remain in communication but are slightly offset from one another. In particular, the second, or upper, level 34 is shifted slightly off vertical toward the periphery of the domed portion 28. In other words, orifices 30 are each formed as a tunnel through domed portion 28 so that the two open ends of each tunnel are necessarily offset from one another, as illustrated in FIGS. 2 and 9, for example. This offset causes the contents of the package to move in an outward direction (radially from the axis of the package) as the contents pass through cap orifices 30. This outward radial movement results in an increased width of the resulting product dispersal pattern. The combination of the bi-level orifices 30 with the dome shape of portion 28 of cap 10 further widens the resulting product distribution pattern when the container contents are dispersed from the package. In the embodiment illustrated in FIG. 9, the offset between a pair of upper and lower orifice openings is approximately 0.120". However, multiple offset ranges are contemplated within the scope of this invention. It is important to provide a sufficient overlap between first level 32 and second level 34 to maintain a suitable flow rate of material. In the example shown in FIG. 10 this overlap dimension is 0.050". The offset and overlap dimensions will vary depending on the product being dispensed (i.e., particle size for powdered and granulated materials and viscosity for liquid materials will be important considerations) and the desired dispersal pattern.

At the approximate center of the domed portion 28 is a vent hole 36. Vent hole 36 is isolated from the orifices 30 on the interior of the cap by a connected or integral vent tube 38. Vent tube 38 is open at its bottom end (internally directed) and mates with an extension tube (not shown) that leads to the bottom interior area of the associated package. This venting structure is arranged to allow air to enter the inverted package to replace the volume of the product dispensed from the package, thus facilitating product flow from the package. Product is not dispensed through vent hole 36 because the preferably cylindrical side wall of the vent tube 38 prevents flow from inside the package of contents to vent hole 36. Thus package product is dispersed only via orifices 30.

The preferred embodiment of the invention has been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

PARTS LIST

10 Cap
12 Rim of 10
14 Depression
16 Closure
18 Living Hinge on 12
20 Serrations
22 Outer Annular Surface
24 Projecting Ring
26 Ring Shaped Recess
27 Valve Seal
28 Domed Portion
30 Orifices
32 $1^{st}$ Level
34 $2^{nd}$ Level
36 Vent Hole
38 Vent Tube
40 Multiple Sealing Surfaces

What is claimed is:

1. A method of providing wide-spread dispersal of a packaged substance, the method comprising the steps of:

providing a package containing a substance of powdered, liquid or granular form;

providing a cap on the package, the cap having a rim and a domed portion formed within the rim and mounted thereto;

the domed portion including a plurality of orifices each having an internal opening and an external opening relative to a thickness of the domed portion, said internal opening having a first centrally located axis and said external opening having a second centrally located axis, said first and second axis being generally parallel and offset from one another, such that the external opening of a particular orifice is off-set from the corresponding internal opening;

inverting the package; and permitting the contents of the package to flow outwardly through the orifices of the cap.

2. A method of increasing flow-rate of material from a package, the method comprising:

providing a package containing a substance of powdered, liquid or granular form;

providing a cap on the package, the cap having a rim and a domed portion formed within the rim and mounted thereto; the domed portion including a plurality of orifices each having an internal opening and an external opening relative to a thickness of the domed portion, said internal opening having a first centrally located axis and said external opening having a second centrally located axis, said first and second axis being generally parallel and offset from one another;

inverting the package; and permitting the contents of the package to flow outwardly through the orifices of the cap.

3. A wide-dispersal package cap comprises:

a rim; and a domed portion formed within the rim and mounted thereto;

the domed portion including a plurality of orifices each having an internal opening and an external opening relative to a thickness of the domed portion, said internal opening having a first centrally located axis and said external opening having a second centrally located axis, said first and second axis being generally parallel and offset from one another such that the external opening of a particular orifice is off-set from the corresponding internal opening.

4. The wide-dispersal package cap of claim 3, further comprising a closure portion connectable to the rim to thereby selectively cover the domed portion and prevent inadvertent release of package contents.

5. The wide-dispersal package cap of claim 4, and further including a living hinge connecting the closure portion to the rim.

6. The wide-dispersal package cap of claim 4 wherein the rim includes a depression and the closure portion has a perimeter that overhangs the depression to thereby provide a thumb grip to facilitate opening the closure portion of the cap.

7. The wide-dispersal package cap of claim 4, wherein the rim has a surface which faces the closure portion and the closure portion has a surface that faces the rim, the surface of the rim having an annular groove and the surface of the closure portion having a correspondingly shaped annular projection to detentingly connect to the annular groove and thereby permit the closure portion to be sealed to the rim.

8. The wide-dispersal package cap of claim 4, wherein the rim has a surface which faces the closure portion and the closure portion has a surface that faces the rim, the surface of the rim having an annular projection and the surface of the closure portion having a correspondingly shaped annular groove to detentingly receive the annular projection and thereby permit the closure portion to be sealed to the rim.

9. The wide-dispersal package cap of claim 3, wherein the rim has a side wall for connection of the cap to a package, the domed portion being disposed at one end of the side wall and an edge located on the end of the side wall opposite the domed portion.

10. The wide-dispersal package cap of claim 9, wherein the edge is serrated to interact with a package to inhibit removal of the cap from the package, for child safety purposes.

11. The wide-dispersal package cap of claim 3, wherein the domed portion is provided with a centrally disposed vent hole to permit entrance of air through the cap and into a package to which the cap is connected.

12. The wide-dispersal package cap of claim 3, wherein the plurality of spaced-apart orifices are arranged in at least one circular pattern on the domed portion.

13. The wide-dispersal package cap of claim 12, wherein the circular pattern of orifices is centered around a central axis of the domed portion.

14. The wide-dispersal package cap of claim 13 wherein the plurality of orifices are arranged in two circular patterns concentrically around the central axis of the domed portion.

15. The wide-dispersal package cap of claim 3, wherein each orifice of the plurality of orifices is formed through a thickness of the domed portion so as to have an area of overlap between a first level at the internal opening and a second level at the external opening of the orifice.

16. The wide-dispersal package cap of claim 3 wherein the external opening of each orifice of the plurality of orifices is vertically offset toward the periphery of the domed portion relative to the position of the corresponding internal opening of the particular orifice such that when a package bearing the cap is inverted with the domed portion generally downward the external openings of each of the orifices are directed radially outwardly, to thereby enhance widespread dispersal of package contents.

17. A combination of a package for dispersal of material and a package cap, the cap comprising:

a rim; and a domed portion formed within the rim and mounted thereto;

the domed portion including a plurality of orifices each having an internal opening and an external opening relative to a thickness of the domed portion, said internal opening having a first centrally located axis and said external opening having a second centrally located axis, said first and second axis being generally parallel and offset from one another such that the external opening of a particular orifice is off-set from the corresponding internal opening.

* * * * *